US006813790B2

(12) United States Patent
Flick et al.

(10) Patent No.: US 6,813,790 B2
(45) Date of Patent: Nov. 9, 2004

(54) SELF-ADJUSTING CUSHIONING DEVICE

(75) Inventors: Roland E. Flick, Elma, NY (US); Raymond P. Paolini, Orchard Park, NY (US); Joel T. Jusiak, Holland, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 0 days.

(21) Appl. No.: 10/378,514

(22) Filed: Feb. 28, 2003

(65) Prior Publication Data

US 2003/0208848 A1 Nov. 13, 2003

Related U.S. Application Data

(60) Provisional application No. 60/428,540, filed on Nov. 21, 2002, and provisional application No. 60/361,449, filed on Feb. 28, 2002.

(51) Int. Cl.[7] ..... A47C 27/10
(52) U.S. Cl. ..... 5/713; 5/710; 5/714
(58) Field of Search ..... 5/710, 713–715, 5/726, 732, 914

(56) References Cited

U.S. PATENT DOCUMENTS

| | | | | |
|---|---|---|---|---|
| 1,576,211 A | * | 3/1926 | O'Kane | 5/710 |
| 3,148,391 A | | 9/1964 | Whitney | |
| 3,792,501 A | * | 2/1974 | Kery | 5/12.1 |
| 4,454,615 A | | 6/1984 | Whitney | |
| 4,483,030 A | | 11/1984 | Flick et al. | |
| 4,679,264 A | * | 7/1987 | Mollura | 5/710 |
| 4,914,771 A | | 4/1990 | Afeyan | |
| 4,945,588 A | | 8/1990 | Cassidy et al. | |
| 4,969,459 A | | 11/1990 | Gusakov | |
| 5,068,935 A | | 12/1991 | Hagopian | |
| 5,072,468 A | | 12/1991 | Hagopian | |
| 5,109,165 A | | 4/1992 | Gusakov | |
| 5,140,309 A | | 8/1992 | Gusakov | |

(List continued on next page.)

FOREIGN PATENT DOCUMENTS

| | | |
|---|---|---|
| EP | 0 558 713 | 3/1998 |
| GB | 2 346 809 | 8/2000 |
| JP | 6503438 | 8/1992 |

*Primary Examiner*—Michael F. Trettel
(74) *Attorney, Agent, or Firm*—Roach Brown McCarthy & Gruber, P.C.; Kevin D. McCarthy

(57) ABSTRACT

A cushioning device including a first fluid bladder support structure having a first surface and an opposing second surface, a second fluid bladder support structure having a first surface and an opposing second surface, and at least one fluid accumulation reservoir. The first and second fluid bladder support structures deform under application of a load and reform upon removal of the load. A first conduit interconnects the first fluid bladder support structure in fluid communication with the second fluid bladder support structure. The first conduit includes a first one-way valve which permits fluid flow from the first fluid bladder support structure to the second fluid bladder support structure. A second conduit interconnects the second fluid bladder support structure in fluid communication with the at least one fluid accumulation reservoir. The second conduit includes a second one-way valve which permits fluid flow from the second fluid bladder support structure to the at least one fluid accumulation reservoir and which is a pressure relief valve. A third conduit interconnects the at least one fluid accumulation reservoir in fluid communication with the first fluid bladder support structure. The third conduit includes a third one-way valve which permits fluid flow from the at least one fluid accumulation reservoir to the first fluid bladder support structure.

43 Claims, 10 Drawing Sheets

U.S. PATENT DOCUMENTS 5,183,039 A 2/1993 Sarian et al.
5,184,112 A 2/1993 Gusakov
D343,531 S 1/1994 Hagopian
D351,071 S 10/1994 Hagopian
5,373,595 A 12/1994 Johnson et al.
5,398,354 A 3/1995 Balonick et al.
5,412,821 A 5/1995 Wilkinson
5,423,094 A * 6/1995 Arsenault et al. ..... 5/655.3
D368,525 S 4/1996 Karten et al.
5,611,096 A * 3/1997 Bartlett et al. ..... 5/617
5,634,224 A 6/1997 Gates
5,634,225 A 6/1997 Miller, Sr. et al.
5,649,331 A * 7/1997 Wilkinson et al. ..... 5/710
5,652,985 A * 8/1997 Wilkinson et al. ..... 5/710
5,666,681 A 9/1997 Meyer et al.
5,699,570 A * 12/1997 Wilkinson et al. ..... 5/713
5,704,084 A 1/1998 Evans et al.
5,745,939 A 5/1998 Flick et al.
5,787,531 A 8/1998 Pepe
5,794,289 A 8/1998 Wortman et al.
5,815,865 A 10/1998 Washburn et al.
5,875,282 A 2/1999 Jordan et al.
5,901,393 A 5/1999 Pepe et al.
5,926,883 A 7/1999 Rechin et al.
5,926,884 A 7/1999 Biggie et al.
5,934,280 A 8/1999 Viard et al.
5,947,168 A 9/1999 Viard
5,957,872 A 9/1999 Flick
5,991,949 A 11/1999 Miller, Sr. et al.
6,061,855 A 5/2000 Flick
6,065,167 A 5/2000 Gancy
6,079,070 A 6/2000 Flick
6,094,762 A 8/2000 Viard et al.
6,099,951 A 8/2000 Flick et al.
6,131,469 A 10/2000 Wortman et al.
6,145,142 A 11/2000 Rechin et al.
6,152,169 A 11/2000 Flick
6,163,909 A 12/2000 Lin
6,200,284 B1 3/2001 Flick
6,351,862 B1 3/2002 Henley et al.
6,357,491 B1 3/2002 Buchanan et al.
6,375,633 B1 4/2002 Endress et al.
6,447,865 B1 9/2002 Flick et al.
6,488,043 B2 12/2002 Flick
6,564,411 B2 * 5/2003 Pirzada ..... 5/713
2002/0029423 A1 3/2002 Ellis et al.

* cited by examiner

SELF-ADJUSTING CUSHIONING DEVICE

The present invention claims the benefit of U.S. Provisional Patent Application Ser. No. 60/361,449, filed Feb. 28, 2002 and U.S. Provisional Patent Application Ser. No. 60/428,540, filed Nov. 21, 2002, which are hereby incorporated by reference in their entirety.

FIELD OF THE INVENTION

The present invention relates to a cushioning device, such as a mattress or mattress overlay, which self-adjusts to provide optimal support and interface pressure for a user.

BACKGROUND OF THE INVENTION

Therapeutic supports for bedridden patients have been well known for many years. Such therapeutic supports include inflatable mattresses and cushions, as well as a variety of foam mattresses and cushions. Most therapeutic mattresses and cushions are designed to reduce "interface pressures," which are the pressures encountered between the mattress and the skin of a patient lying on the mattress. It is well known that interface pressures can significantly affect the well-being of immobile patients in that higher interface pressures can reduce local blood circulation, tending to cause bed sores and other complications. With inflatable mattresses, such interface pressures depend (in part) on the air pressure within the inflatable support cushions. Most inflatable therapeutic mattresses are designed to maintain a desired air volume within the inflated cushion or cushions to prevent bottoming. "Bottoming" refers to any state where the upper surface of any given cushion is depressed to a point that it contacts the lower surface, thereby markedly increasing the interface pressure where the two surfaces contact each other.

One type of therapeutic support is an inflatable cushion used as an overlay (i.e., a supplemental pad positioned on top of an existing structure, such as a mattress). For example, the Sof-Care® cushions of Gaymar Industries, Inc. are cushions which overlay an existing mattress and which include a multitude of lower individual air chambers and a multitude of upper individual air chambers with air transfer channels therebetween. Air is transferred through the interconnecting channels to redistribute the patient's weight over the entire bed cushion. A three layer overlay cushion known as the Sof-Care® II cushion continually redistributes patient weight through more than 300 air-filled chambers and may include hand grips at the side of the cushion to assist in patient positioning. In these types of cushions, the individual air chambers remain pressurized.

However, when the overlay cushions described above or inflatable mattress units are used, a separate pump or air source is typically required to adjust the pressure in the inflatable cells. Such adjustment is required for each user when initially using the cushion or mattress and to make any changes to the air pressure within the air cells during use.

Thus, these cushioning systems are multi-component systems including two major components, an inflatable portion and a pump/air source. Therefore, these cushioning systems are more expensive and are more difficult to use by untrained users. Moreover, these cushioning systems require user interface or manual adjustments to control pressure within the device.

Accordingly, there remains a need for a simple cushioning device which does not require a pump device/external fluid source to adjust the pressure within the cushioning device. The present invention is directed to overcoming these and other deficiencies in the art.

SUMMARY OF THE INVENTION

The present invention relates to a cushioning device including a first fluid bladder support structure having a first surface and an opposing second surface, a second fluid bladder support structure having a first surface and an opposing second surface, and at least one fluid accumulation reservoir. The first and second fluid bladder support structures deform under application of a load and reform upon removal of the load. A first conduit interconnects the first bladder support structure in fluid communication with the second fluid support structure. The first conduit includes a first one-way valve which permits fluid flow from the first fluid bladder support structure to the second fluid bladder support structure. A second conduit interconnects the second fluid bladder support structure in fluid communication with at least one fluid accumulation reservoir. The second conduit includes a second one-way valve which permits fluid flow from the second fluid bladder support structure to the at least one fluid accumulation reservoir and which is a pressure relief valve. A third conduit interconnects the at least one fluid accumulation reservoir in fluid communication with the first fluid bladder support structure. The third conduit includes a third one-way valve which permits fluid flow from the at least one fluid accumulation reservoir to the first fluid bladder support structure.

The present invention also relates to a cushioning device including at least one fluid bladder support structure having a first surface and an opposing second surface and a fluid accumulation reservoir structure, wherein the at least one fluid bladder support structure is positioned within the fluid accumulation reservoir structure. The at least one fluid bladder support structure deforms under application of a load and reforms upon removal of the load. At least one pressure relief valve is provided in fluid communication with the at least one fluid bladder support structure and the fluid accumulation reservoir structure. The at least one pressure relief valve is a first one-way valve which permits fluid flow from the at least one fluid bladder support structure to the fluid accumulation reservoir structure. At least one second one-way valve is provided in fluid communication with the at least one fluid bladder support structure and the fluid accumulation reservoir structure. The at least one second one-way valve permits fluid flow from the fluid accumulation reservoir structure to the at least one fluid bladder support structure.

Another aspect of the present invention relates to a cushioning device including at least one fluid bladder support structure, a plurality of fluid accumulation reservoirs, and at least one shut-off valve. The fluid bladder support structure deforms under application of a load and reforms upon removal of the load. The plurality of fluid accumulation reservoirs are interconnected to be in fluid communication. The manual shut-off valve is in fluid communication with the fluid bladder support structure and at least one of the plurality of fluid accumulation reservoirs. As used herein, a plurality comprises two or more fluid accumulation reservoirs.

Yet another aspect of the present invention relates to a cushioning device including at least one fluid bladder support structure and at least one fluid accumulation reservoir interconnected in fluid communication with the fluid bladder support structure. The fluid bladder support structure deforms under application of a load and reforms upon removal of the load. The fluid accumulation reservoir has a movable adjustment device which adjusts the volume of the at least one fluid accumulation reservoir.

The cushioning device of the present invention provides a simple, one-component device for home or hospital use for providing pressure relief so that pressure ulcers may be eliminated or retarded. The air cells in the support bladder of the cushioning device are in fluid communication with a reserve reservoir to continually self-regulate, balance, and conform to the therapeutic needs of the user. Thus, the cushioning device of the present invention provides self-adjusting, customized pressure management. Further, the cushioning device may include multiple, independently adjusting zones in the support bladder, without the need for multiple reserve reservoirs for such independent zones (thus increasing the support area available for the user of the cushioning device). Moreover, a resilient device, if present within the cells of the support bladder, applies no additional pressure to the fluid in the device. In addition, the cushioning device may be provided as a completely closed system, i.e., the device does not obtain fluid from an external source, such as atmosphere or a fluid pump. Thus, the cushioning device is not exposed to external contaminants and is protected from potential leaks (more common in systems pulling fluid from an outside source). In addition, the elimination of the need for an external pump device reduces costs and makes the cushioning device easy to use for an untrained user.

DETAILED DESCRIPTION OF THE INVENTION

Figure 1:
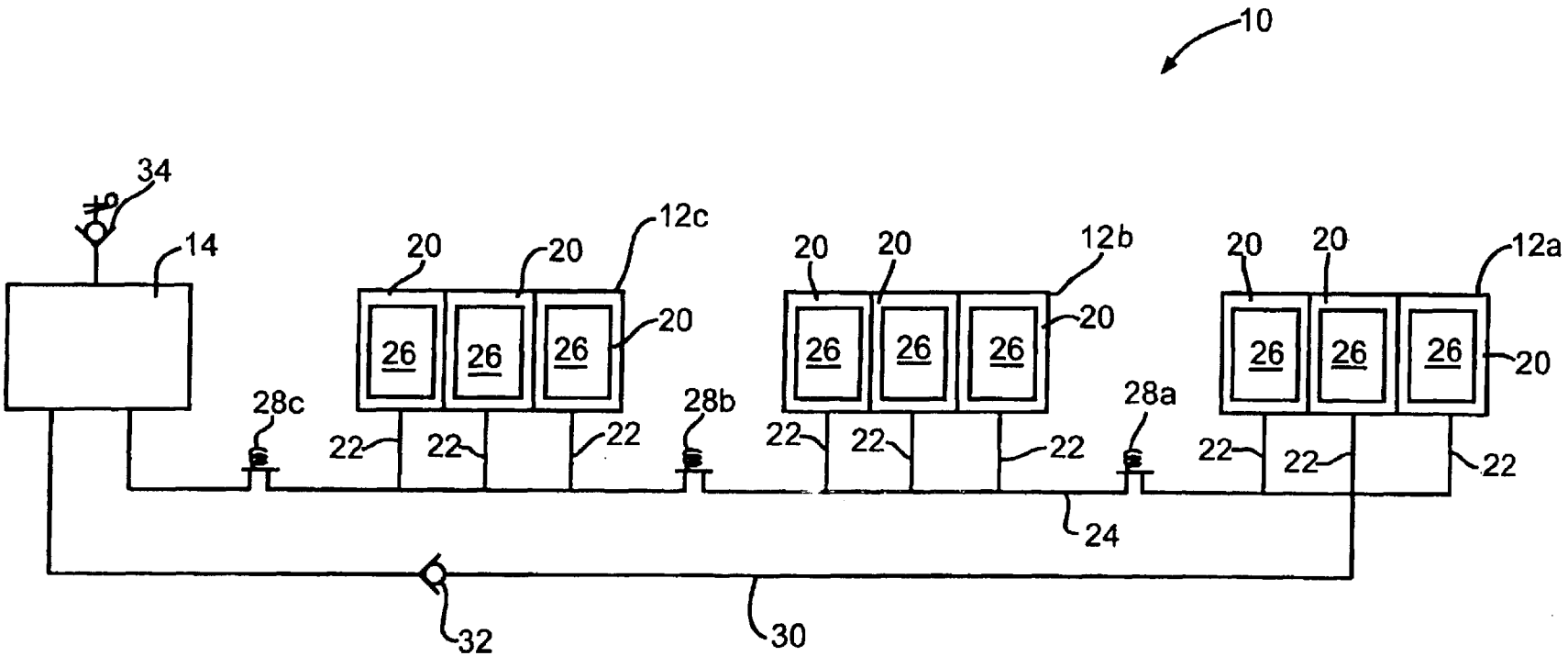
FIG. 1 is a schematic of a cushioning device in accordance with a first embodiment of the present invention.
Figure 2:
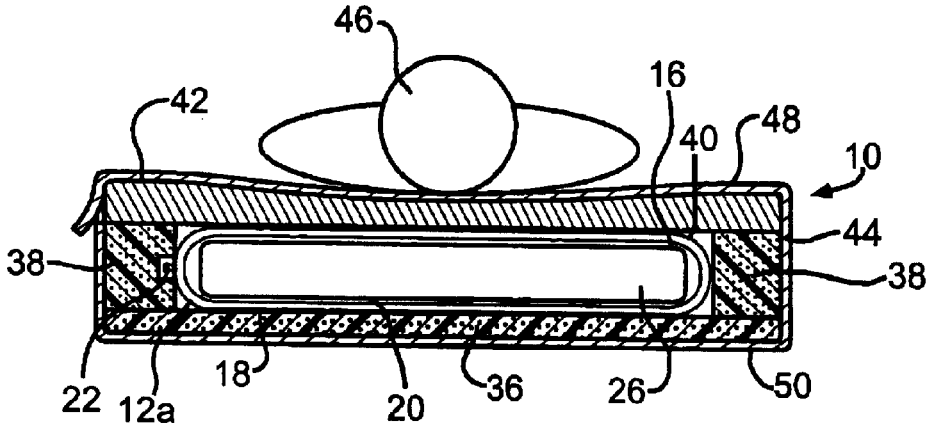
FIG. 2 is an end view of the cushioning device of FIG. 1.
Figure 3:
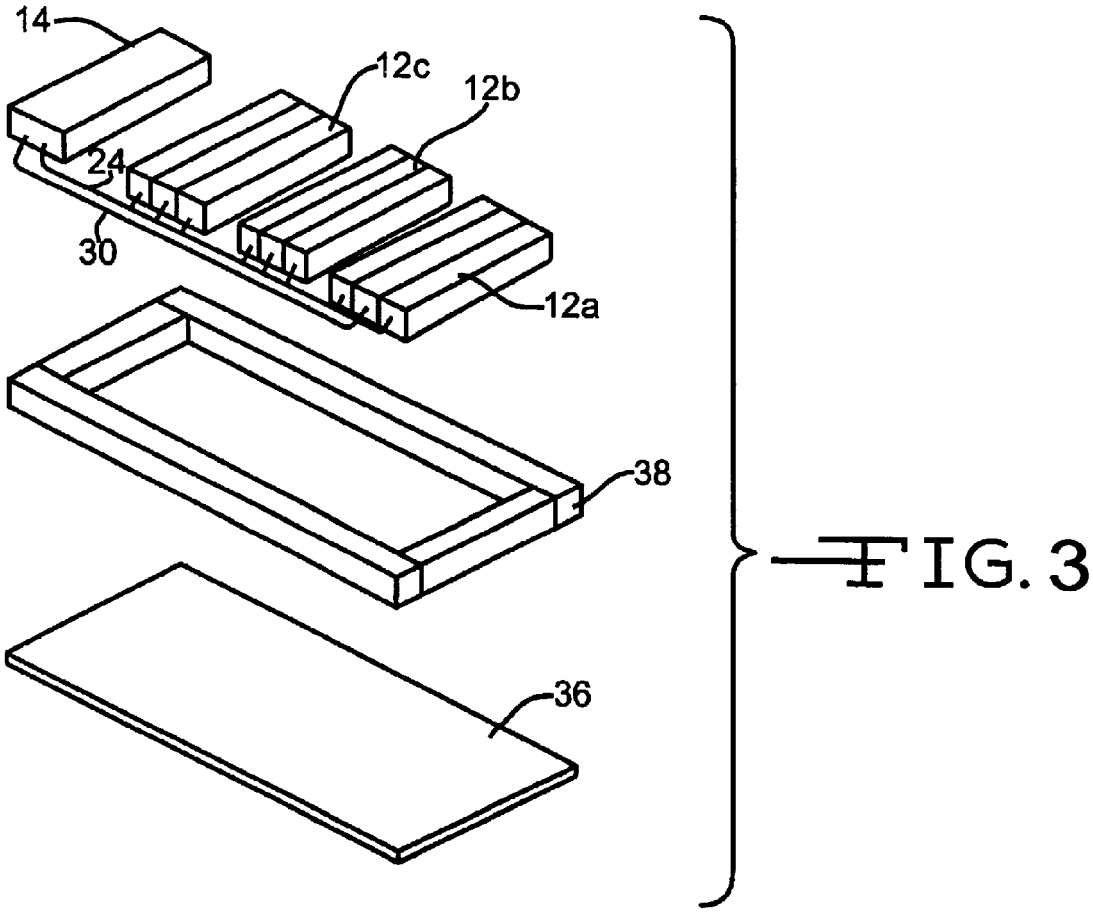
FIG. 3 is an exploded view of the cushioning device of FIG. 1.

A cushioning device 10 in accordance with one embodiment of the present invention is shown in FIGS. 1–3. The cushioning device 10 includes fluid bladder support sections 12*a*–*c*, which support the user and provide pressure relief to the user so that the development of pressure ulcers is prevented or retarded. The cushioning device also includes a fluid accumulation reservoir 14 in fluid communication with the fluid bladder support sections 12*a*–*c*. The cushioning device 10 is a simple device for home or hospital use which eliminates the need for a fluid pump device for making pressure adjustments, thereby making the cushioning device 10 easy to use for an untrained user. In addition, the cushioning device 10 provides a self-adjusting support which delivers the benefits of a powered unit, without the user interface requirement, the energy costs associated with a powered unit, or the power outage or failure concerns of a powered unit.

In this particular embodiment, as shown in FIGS. 1–3, the fluid bladder support structure is a bladder having a first section 12*a*, a second section 12*b*, and a third section 12*c* and is capable of being filled with a fluid, although the support structure can have other numbers of sections. In this particular embodiment, the first section 12*a* is a head support section, the second section 12*b* is a pelvis support section, and the third section 12*c* is a lower leg support section, however, any number of fluid support sections 12 can be arranged to support any body portions. Each of the first, second, and third sections 12*a*–*c* have a first surface 16 and an opposing second surface 18. In this embodiment, a user 46 is positioned on cover 48 (described below), although user 46 may be positioned on or adjacent first surface 16. The fluid bladder support sections 12*a*–*c* are made of suitable puncture-resistant vinyl film or other suitable air impervious flexible material, such as reinforced films or coated films of vinyl, urethane, or other air impervious materials. The bladders may be made of one, two, three, or any number of layers of air impervious flexible material.

As shown in FIG. 1, each fluid bladder support section 12*a*, 12*b*, 12*c* is comprised of three individual side-by-side cells 20, however, any number of cells 20 may be used. For example, a single cell for each section 12*a*, 12*b*, 12*c* may be used. Each fluid bladder support section 12*a*, 12*b*, 12*c* may have a height when filled with fluid of about five inches. However, the height of the fluid bladder support section 12 may be varied as desired.

In this particular embodiment, cells 20 may be attached to each other, for example, by heat welding. Each of the cells 20 is connected through a conduit 22 to a fluid transfer conduit 24. The fluid transfer conduit 24 connects, in series, fluid bladder support section 12*a* to fluid bladder support section 12*b* to fluid bladder support section 12*c* and to fluid accumulation reservoir 14 and allows the transfer of fluid from fluid bladder support section 12*a* through fluid bladder support sections 12*b* and 12*c* to fluid accumulation reservoir 14. In an alternative embodiment, each of the cells 20 within each section may be interconnected, such that fluid flows between each cell 20 to equalize pressure within each fluid bladder support section 12*a*, 12*b*, 12*c*. In this embodiment, a single conduit 22 would be required to connect each fluid bladder support section 12*a*, 12*b*, 12*c* to the fluid transfer conduit 24.

The cells 20 and fluid support sections 12*a*–*c* in this embodiment are substantially rectangular, however, any suitable shape may be used, such as cubic or cylindrical. The shape of the cells 20 and fluid support sections 12*a*–*c* is determined by the area of the user being supported and the quantity of cells and fluid bladder support sections used. In addition, in the embodiment shown in FIGS. 1–3, cells 20 extend across the width of cushioning device 10. Alternatively, cells 20 may extend along the length of cushioning device 10.

As shown in FIGS. 1 and 2, each cell 20 includes an inner resilient device 26. As described below, the inner resilient device aids in pressure control in the cushioning device 10. In this particular embodiment, the inner resilient device 26 is a foam material which allows the flow of fluid therethrough, however, any other suitable resilient device may be used, including, but not limited to, gels, polybeads, elastic materials, and springs. The inner resilient device 26 is deformable when a load is applied but will return to its original shape (i.e., reform) upon removal of the load. Also, in this particular embodiment, the inner resilient device 26 is a solid material. However, other configurations of the inner resilient device may be used. For example, the inner resilient device 26 may include apertures or may be constructed in an I-beam design. These configurations allow the use of higher quality resilient materials (which last longer), but will feel less rigid to the user due to the apertures or I-beam design. Alternatively, the resilient device may be provided on the outside of the cells 20. In the above-described embodiments, the inner resilient device is configured to minimize the spring force to the user positioned on the cushioning device 10. This reduces the tissue interface pressure for the user positioned on the cushioning device 10.

In yet another alternative embodiment, the fluid bladder support sections 12*a–c*, themselves, may be formed of a resilient material which allows the fluid bladder support sections 12*a–c* to deform when a load is applied, but return to their original shape (i.e., reform) upon removal of the load. Any suitable resilient material may be used, as described above.

Each cell 20 may have a plurality of button welds which surround portions of the inner resilient device to prevent ballooning of the cell. The button welds produce a plurality of interconnected chambers in each cell. Such systems are shown, for example, in U.S. Pat. No. 5,794,289, which is hereby incorporated by reference in its entirety. The number of chambers in each cell may vary, however, suitable numbers of chambers include from about 50 to about 300 chambers. As the chambers exchange air or any other suitable medium, the user's weight is redistributed over the entire cell.

Referring to FIGS. 1 and 3, the cushioning device 10 further includes a fluid accumulation reservoir 14. Although only one fluid accumulation reservoir 14 is shown, any number of fluid accumulation reservoirs 14 may be used. In the embodiment shown in FIGS. 1 and 3, the fluid accumulation reservoir 14 is positioned below the feet of the user and is a flexible fluid reservoir, however, the fluid accumulation reservoir(s) may be positioned anywhere within (see, e.g., FIG. 7) or adjacent the cushioning device.

The fluid accumulation reservoir 14 is in fluid communication with the fluid support sections 12*a–c* through fluid transfer conduit 24. In this particular embodiment, pressure relief valves 28*a*, 28*b*, and 28*c* are positioned in the fluid transfer conduit 24 between fluid bladder support section 12*a* and fluid bladder support section 12*b*, between fluid bladder support section 12*b* and fluid bladder support section 12*c*, and between fluid bladder support section 12*c* and fluid accumulation reservoir 14, respectively. The pressure relief valves 28*a–c* are one-way valves which allow fluid to transfer from fluid bladder support section 12*a* to fluid bladder support section 12*b* when the pressure in fluid bladder support section 12*a* exceeds a predetermined relief pressure, from fluid bladder support section 12*b* to fluid bladder support section 12*c* when the pressure in fluid bladder support section 12*b* exceeds a predetermined relief pressure, and from fluid bladder support section 12*c* to fluid accumulation reservoir 14 when the pressure in fluid bladder support section 12*c* exceeds a predetermined relief pressure. Each pressure relief valve may be set to the same or different predetermined relief pressures, such that each fluid support section is an independently controlled zone. Independently controlled zones allow for greater customization and better meet the unique anatomical needs of the upper body, torso, lower legs, and heel sections. Each pressure relief valve 28*a–c* may be limited to a single pressure value or may be adjustable, such that the user determines the pressure of each zone. As used herein, adjustable pressure relief valves may include valves which can be adjusted by the user or those which are adjusted by the manufacturer to user specifications. Such adjustable pressure relief valves are known in the art and may include a pressure regulator to permit control of the predetermined relief pressure. Although valves 28*a* and 28*b* are shown as pressure relief valves, simple one-way or check valves may also be used for valves 28*a* and 28*b*.

As shown in FIGS. 1 and 3, the cushioning device 10 further includes a return conduit 30. Return conduit 30 includes a one-way check valve 32 which allows fluid to flow from fluid accumulation reservoir 14 to fluid support section 12*a*.

Referring to FIG. 1, the cushioning device 10 also includes a atmosphere adjustment valve 34 (e.g., a Schrader valve and pin) attached to the fluid accumulation reservoir 14, although the atmosphere adjustment valve may be positioned at any desired location on the cushioning device 10. The atmosphere adjustment valve 34 maintains the cushioning device 10 as an open system during transport to compensate for altitude changes. The valve is then closed to close the cushioning device for use. In one embodiment, the pin of the valve is attached to packaging for the cushioning device 10 such that upon opening the packaging, the valve is closed and the cushioning device is ready for use. The system, once closed, contains fluid which is substantially at atmospheric pressure when no load is applied to the cushioning device 10. When a load is applied, the cushioning device desirably provides an interface pressure which is lower than that provided by standard hospital mattresses. In an alternative embodiment, the cushioning device 10 may also include a one-way check valve in fluid communication with the atmosphere to replace any lost air, e.g., due to the vapor transmission rate of the materials for the fluid bladder support and accumulation reservoir.

Referring to FIGS. 2 and 3, in this embodiment, the cushioning device 10 further includes a foam support member 36 on which rest the fluid bladder support sections 12*a–c*. The foam support member 36 may have a thickness of, for example, about one inch. Although the support member 36 in this embodiment is a foam support member, any support material may be used. Surrounding the periphery of the fluid bladder support sections 12*a–c* is a crib 38. Such cribs are known in the art and are described, for example, in U.S. Pat. No. 5,794,289, which is hereby incorporated by reference in its entirety. This crib 38 comprises a resilient material, such as foam, foam beads, gels, batting, or other suitable materials, and retains and protects the fluid support sections 12*a–c* and conduits 22, 24, and 30. In this particular embodiment, the crib 38 is a polyurethane foam. Cut outs in the crib 38 may be provided for conduits 22, 24, and 30. The crib 38 provides strong support for the user or caregiver and facilitates entry and exit stability. In addition, as shown in FIG. 2, a wrap 40 surrounds the cells 20 in fluid bladder support sections 12*a–c* to hold the cells close together and to prevent cell migration and bottoming. However, the cells 20 may be provided without a wrap 40. A top layer 42 bridges across and is adhesively or otherwise suitably attached to the upper surface of crib 38. In this particular embodiment, the top layer 42 is a foam layer, however, any cushioning material may be used. The top layer 42 may enhance the comfort of the user and may be a sculpted foam layer. The top layer 42 may include other features, such as tapering at the foot portion to reduce heel pressures, vent passages from the fluid bladder support area to allow air movement for a low air loss system as described below, and relief holes, channels, grooves, or cavities to allow expansion of the foam in order to minimize the hammock effect created by placing foam over the fluid support bladder area (see, e.g., FIGS. 7 and 8). In another embodiment, the cushioning device 10 may include fabric strips or webs composed of non-woven nylon or other suitable strong fabric material which extend between and are attached to the sides of crib 38 to stabilize the crib 38 (see, e.g., U.S. Pat. No. 5,794,289, which is hereby incorporated by reference in its entirety).

As shown in FIG. 2, the foam support member 36, crib 38, wrap 40, top layer 42, and fluid bladder support sections 12*a–c* are enclosed within a zippered mattress cover 44. The cover 44 is made of a suitable material to reduce friction, sheer, and hammocking. In addition, the cover 44 may be made stain resistant and/or moisture resistant. Suitable materials for the cover 44 include, but are not limited to, nylon, especially low vapor transmission nylon, and weft knitted nylon fabric which has an elastomeric polyurethane transfer coating to be water repellent and increase durability, such as that sold by Penn Nyla (Nottingham, England) and identified as Dartex P072, P171, or P272. User 46 is positioned on a first surface 48 of the cover 44. A second surface 50 of the cover 44 may be provided as a non-skid surface, as described in U.S. Pat. No. 5,794,289, which is hereby incorporated by reference in its entirety.

In an alternative embodiment, the cushioning device 10 may be provided without any or all of the foam support member 36, crib 38, wrap 40, top layer 42, and cover 44 (see, e.g., FIG. 7), for example, as an overlay for a mattress.

Figure 4:
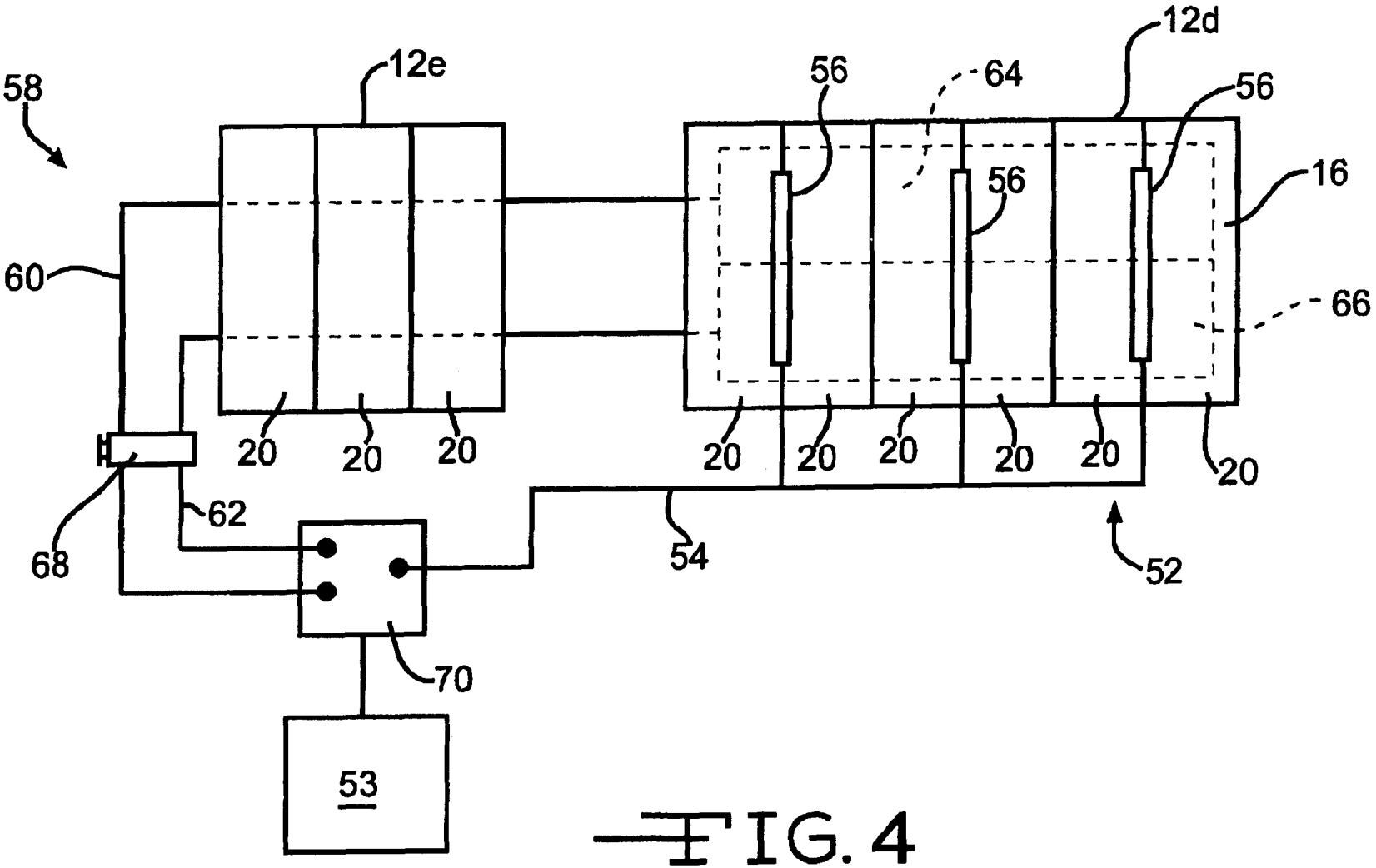
FIG. 4 is a schematic of a fluid bladder support section in accordance with a second embodiment of the present invention.

Referring to FIG. 4, a second embodiment of the fluid bladder support structure of the present invention is shown. This embodiment of the present invention is identical to the previously described embodiment, except as described below.

In this embodiment of the present invention, the fluid bladder support structure comprises two sections 12*d* and 12*e*. Fluid bladder support section 12*d* includes six cells 20 and supports the head and pelvis of the user. Fluid bladder support section 12*e* includes three cells 20 and supports the lower legs of the user.

Also, as shown in FIG. 4, this embodiment of the present invention includes a low air loss system 52. The low air loss system 52 includes an air source 53, such as an electrical air pump (e.g., a powered air loss pump (e.g., model CL250, CL360, or AFP45) marketed by Gaymar Industries, Inc.). However, any suitable air source may be used. The air source is in fluid communication with a low air loss line 54, which is in fluid communication with low air loss tubes 56 positioned adjacent the first surface 16 of fluid bladder support section 12*d* and extending widthwise. Although shown adjacent all cells 20, the low air loss tubes may be positioned adjacent any number of cells 20. Alternatively, the low air loss tubes may be positioned to extend lengthwise (i.e., from a head end to a foot end of the cushioning device) adjacent the fluid bladder support sections (see, e.g., 56' in FIGS. 8–10). The low air loss tubes 56 include a plurality of pin holes or micro-vents to produce a gentle flow of air beneath the user and to minimize moisture build-up and/or to regulate temperature of the user.

In addition, in the embodiment of the present invention shown in FIG. 4, a rotational bladder system 58 is provided. Suitable rotational bladder systems are known in the art and are described, for example, in U.S. Pat. No. 5,794,289, U.S. Pat. No. 5,926,883, U.S. Pat. No. 6,079,070, and U.S. Pat. No. 6,145,142, which are hereby incorporated by reference in their entirety. Briefly, the rotational bladder system 58 includes inlet hoses 60 and 62 which connect to first and second inflatable bladders 64 and 66, respectively. First and second inflatable bladders 64 and 66 are positioned below fluid support bladder 12*d*. The first and second inflatable bladders 64, 66 are side-by-side bladders which extend lengthwise, i.e., from a head end to a foot end of the cushioning device 10, beneath fluid support bladder section 12*d*. The first and second inflatable bladders 64, 66 each include a connector (not shown) for receiving air from inlet hoses 60, 62 which are connected to an inflation-deflation device, such as a pump (not shown). In this particular embodiment, a single fluid bladder support section 12*d* is provided over the bladders 64, 66, however, multiple fluid bladder support sections could be used. In addition, any number of bladders 64, 66 may be used.

The first and second inflatable bladders 64, 66 are made of suitable puncture-resistant vinyl film or other suitable air impervious flexible material. The bladders 64, 66 are suitably formed to be welded together utilizing principles commonly known to those of ordinary skill in the art to which this invention pertains. However, alternative techniques for attaching the first and second inflatable bladders 64, 66 may be used. The first and second inflatable bladders 64, 66 may be formed with notches to provide greater lifting force to the shoulders, chest, and abdomen areas of the user, as described, for example, in U.S. Pat. No. 6,079,070, which is hereby incorporated by reference in its entirety.

For inclining the first surface 16 of the support bladder section 12*d* for assisting in turning the user over, the first inflatable bladder 64 is deflated, while the second inflatable bladder 66 is inflated. Likewise, for inclining the first surface 16 of the support bladder section 12*d* to the other side for assisting in turning the user over, the second inflatable bladder 66 is deflated, while the first inflatable bladder 64 is inflated. The air pressure required to rotate the user depends on the user's weight, body type, and various other parameters.

This particular embodiment further includes a CPR dump device 68. Such CPR dump devices, which allow for rapid deflation for emergency care (e.g., cardiopulmonary resuscitation (CPR) (see, e.g., U.S. Pat. No. 6,061,855, which is hereby incorporated by reference in its entirety)), are known in the art and will not be described in detail herein. Briefly, the CPR dump device 68 includes a short length of high flow tubing (e.g., ½ inch tubing) for quick release of air from the turning bladders 64 and 66 and a pin. When the pin is pulled air rapidly exits from the turning bladders 64 and 66, through conduits 60 and 62, and out through the short length of high flow tubing. A panel 70 is also provided for control of the low air loss system 52 and rotational bladder system 58.

Figure 5:
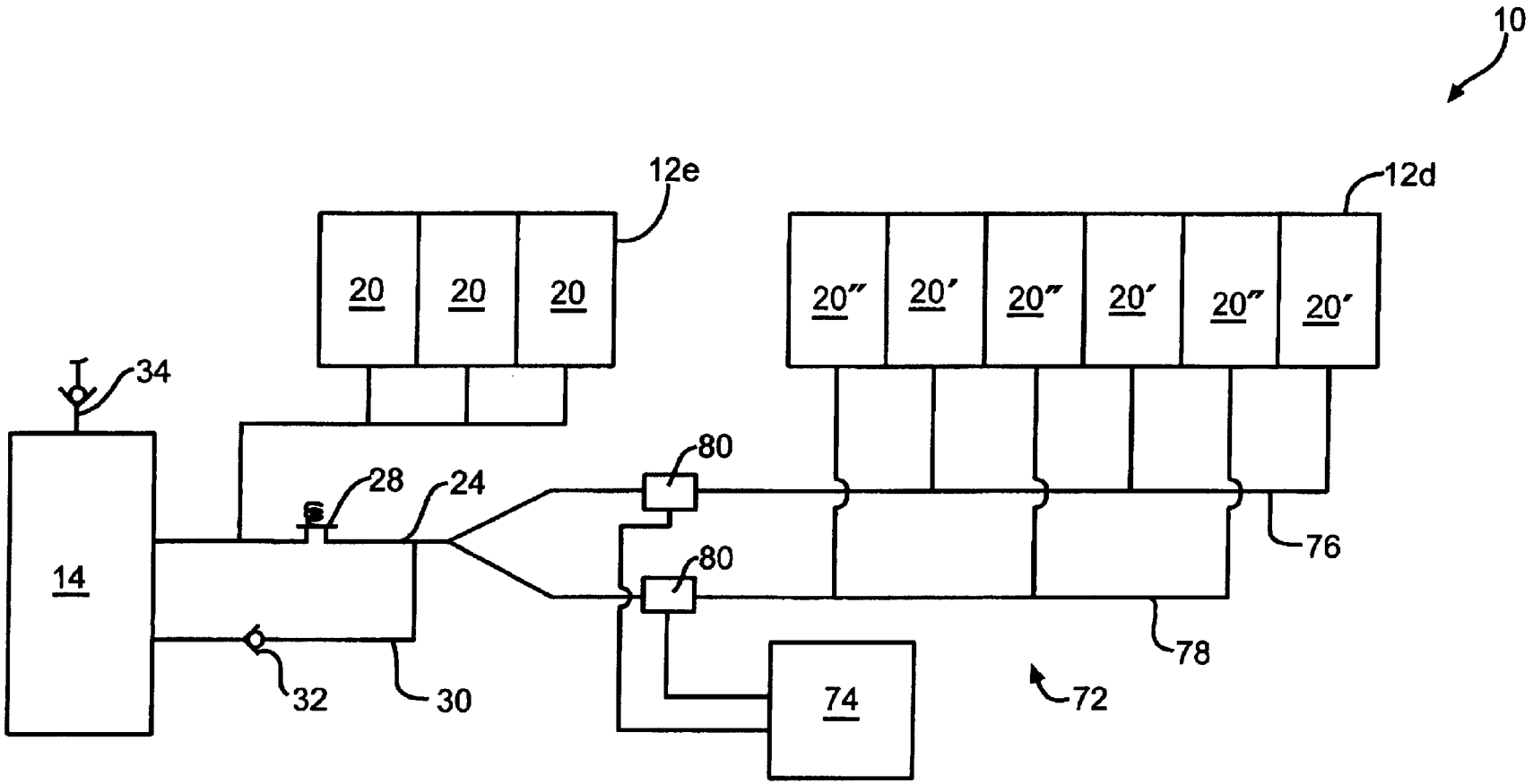
FIG. 5 is a schematic of a cushioning device in accordance with a third embodiment of the present invention.

A third embodiment of the present invention is shown in FIG. 5. This embodiment of the present invention is identical to the previously described embodiments, except as described below.

Referring to FIG. 5, this embodiment of the present invention includes an alternating pressure system 72. In particular, the fluid bladder support section 12*d* is of the alternating pressure type, i.e., it has at least two series of alternating cells, which are alternately inflated and deflated, one series of cells being inflated while the other series of cells is deflated. Such alternating pressure type cushions are disclosed, for example, in U.S. Pat. Nos. 5,794,289 and 5,901,393, which are hereby incorporated by reference in their entirety, and relieve excess pressure on patients at risk of developing pressure ulcers or relieve excess pressure on patients with pressure ulcers. Briefly, the alternating pressure system 72 includes an alternating pressure pump 74, a first conduit 76 connected to a first series of cells 20', and a second conduit 78 connected to a second series of cells 20". In addition, disconnect devices 80 for the alternating pressure system are located on each conduit 76 and 78. The alternating pressure pump 74 alternatively inflates and deflates the first series of cells 20' and the second series of cells 20" in fluid bladder support section 12*d*.

Figure 6:
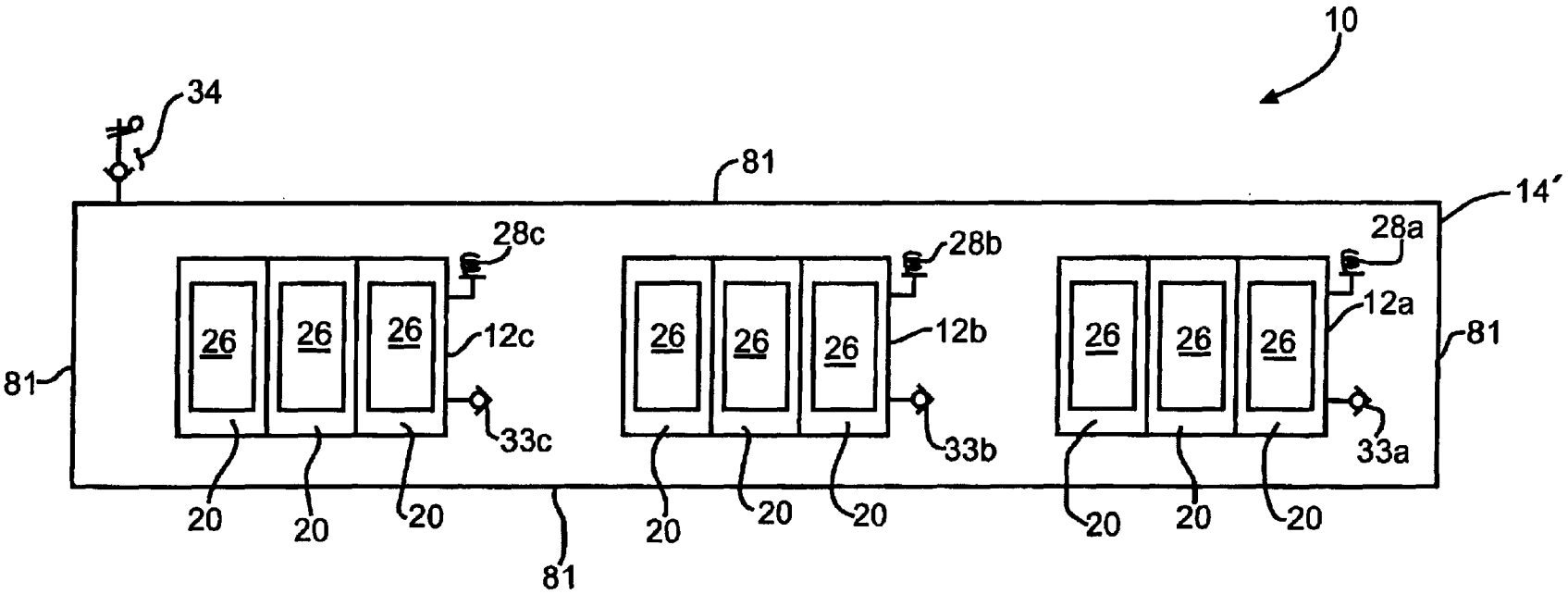
FIG. 6 is a schematic of a cushioning device in accordance with a fourth embodiment of the present invention.

A fourth embodiment of the present invention is shown in FIG. 6. This embodiment of the present invention is identical to the first embodiment, except as described below.

In this embodiment of the present invention, the fluid bladder support sections 12*a–c* are positioned within fluid accumulation reservoir structure 14' having flexible walls 81 which surround and encapsulate the fluid bladder support sections 12*a–c*. Although one fluid accumulation reservoir structure is shown, multiple encapsulating fluid accumulation reservoir structures may be used. The fluid bladder support sections 12*a–c* include pressure relief valves 28*a–c*, which are in fluid communication with each fluid bladder support section 12*a–c*, respectively, and the fluid accumulation reservoir 14. The pressure relief valves 28*a–c* allow fluid to transfer from fluid bladder support sections 12*a–c* to fluid accumulation reservoir 14 when the pressure in the fluid bladder support sections exceeds predetermined relief pressures. In addition, one-way valves 33*a–c* are provided in fluid communication with each fluid bladder support section 12*a–c*, respectively, and the fluid accumulation reservoir 14. The one-way valves 33*a–c* allow fluid to transfer from the fluid accumulation reservoir 14 into the fluid bladder support sections 12*a–c*, respectively. In this particular embodiment, the pressure relief valves 28*a–c* and one-way valves 33*a–c* are in direct communication with the fluid bladder support sections 12*a–c*, respectively. However, conduits between fluid bladder support sections 12*a–c* and the pressure relief valves 28*a–c* and/or the one-way valves 33*a–c*, respectively, may be provided. In addition, although separate valve assemblies are shown for the pressure relief valves 28*a–c* and the one-way valves 33*a–c*, a single valve assembly which allows fluid to transfer from each fluid bladder support section 12*a*, 12*b*, 12*c* to fluid accumulation reservoir 14 when the pressure in the fluid bladder support sections exceeds a predetermined relief pressure and allows one-way fluid transfer from the fluid accumulation reservoir 14 into the fluid bladder support sections 12*a–c* may be used.

Also, in this particular embodiment, cells 20 in fluid bladder support sections 12*a–c* are interconnected, such that a single pressure relief valve 28 and a single one-way valve 33 is needed for each fluid bladder support section. However, the cells 20 may be independent cells, each having a pressure relief valve 28 and a one-way valve 33.

In use, the atmosphere adjustment valve 34 is closed, making the cushioning device 10 a closed system (i.e., the device is not in fluid communication with the ambient atmosphere or any other external fluid source to control pressure within the fluid bladder support sections during use).

Figure 7:
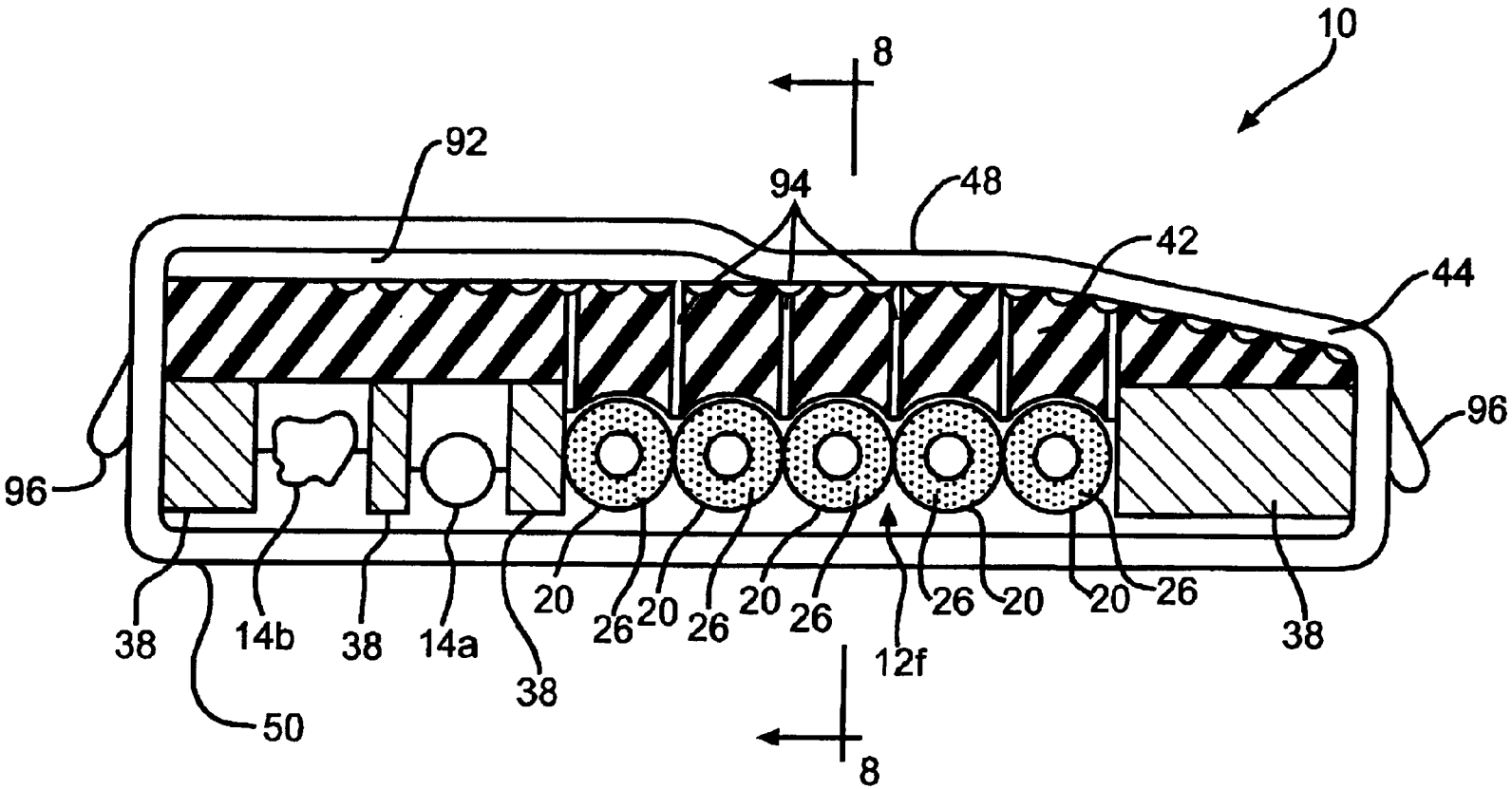
FIG. 7 is a cross-sectional, side view of a cushioning device in accordance with a fifth embodiment of the present invention.
Figure 8:
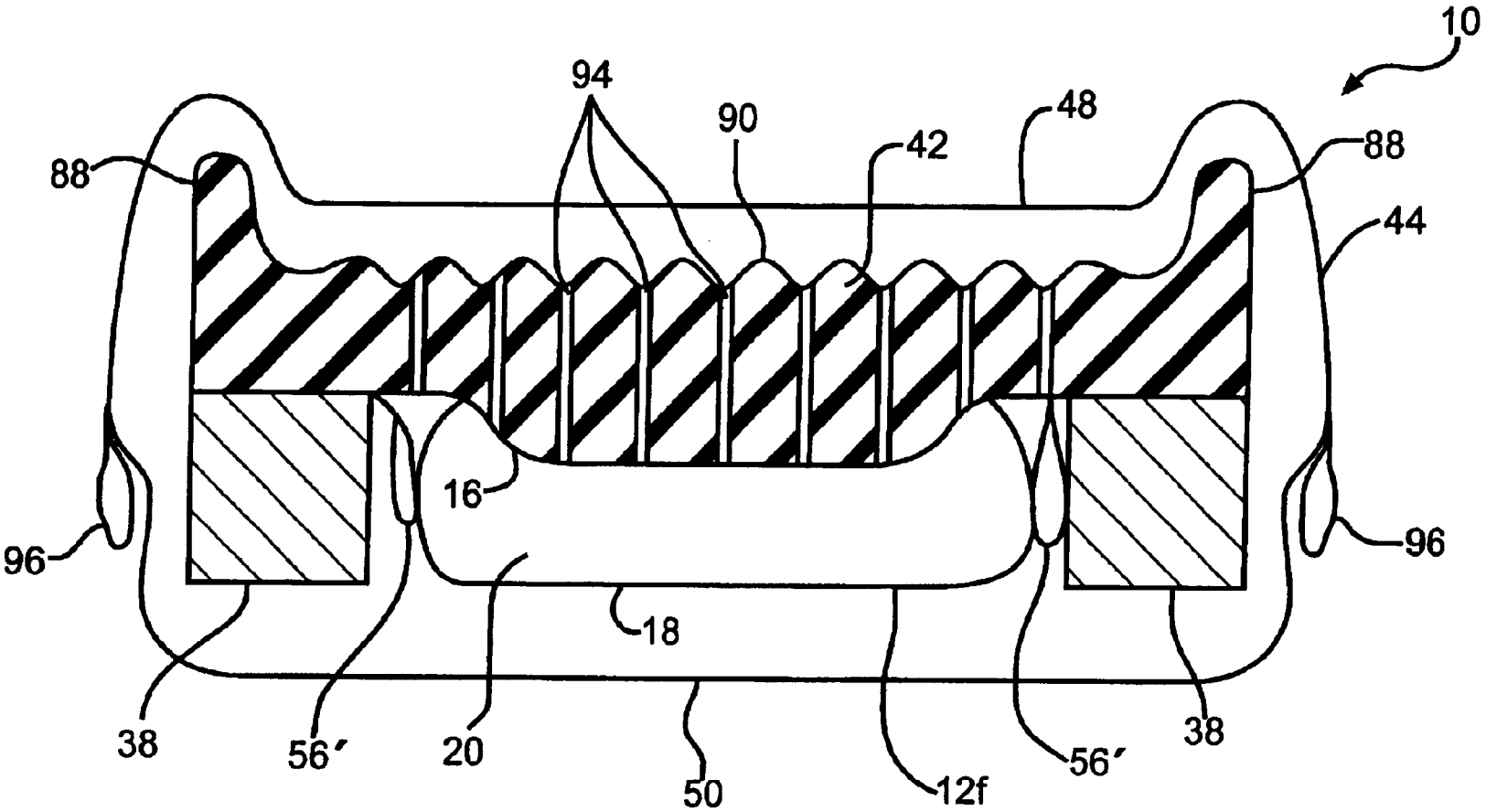
FIG. 8 is a cross-sectional view of the cushioning device of FIG. 7 along line 8—8.
Figure 9:
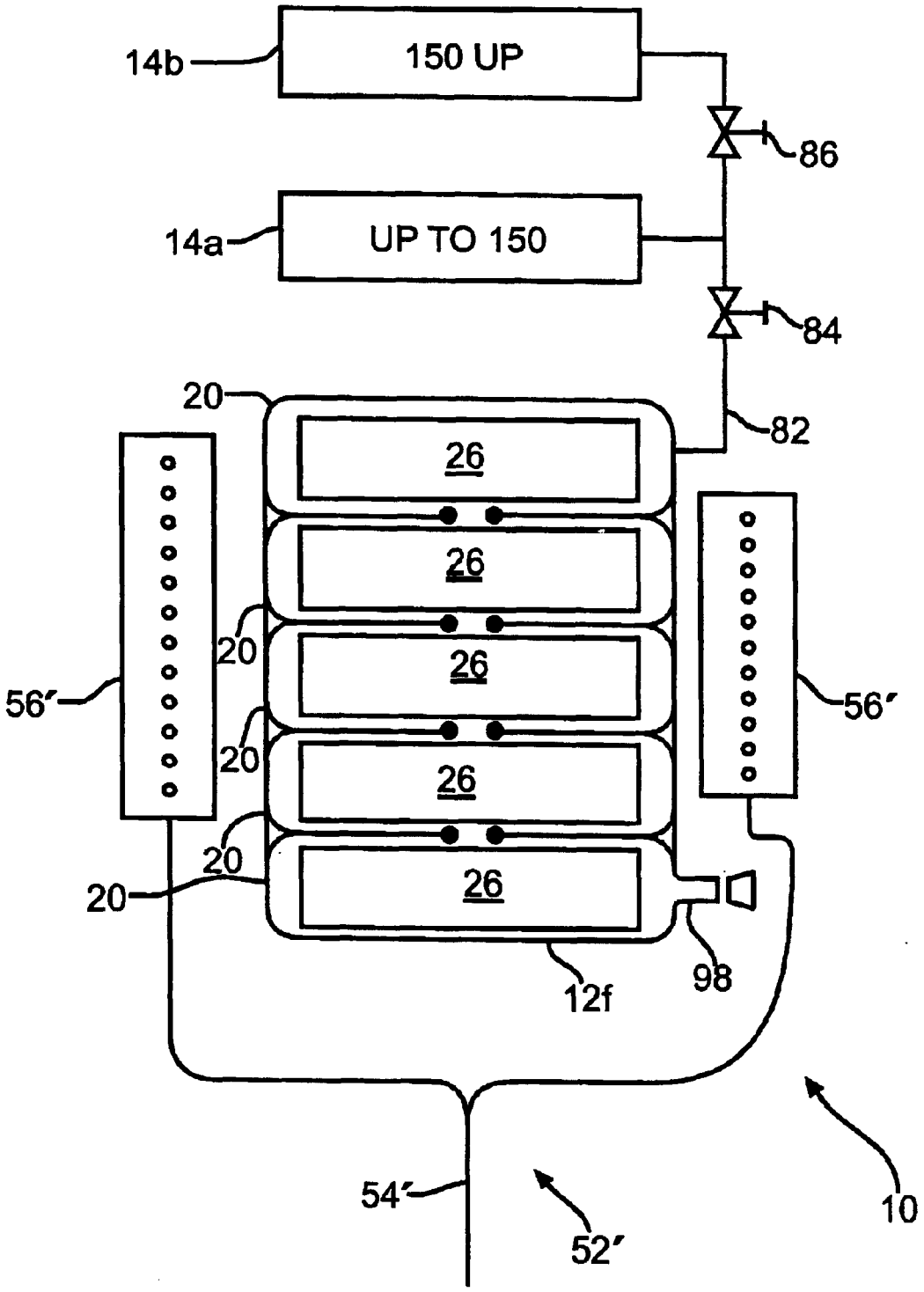
FIG. 9 is a schematic of the cushioning device of FIG. 7.

A fifth embodiment of the present invention is shown in FIGS. 7–9. This embodiment of the present invention is identical to the first embodiment, except as described below.

In this embodiment of the present invention, multiple fluid accumulation reservoirs 14*a*, 14*b* are provided in fluid communication with a single fluid support bladder section 12*f*. Fluid support bladder section 12*f* includes five interconnected cells 20, each including a resilient device. In this particular embodiment, fluid accumulation reservoirs 14*a*, 14*b* are flexible reservoirs having a fixed maximum volume. However, fluid accumulation reservoirs 14*a*, 14*b* may be rigid.

Referring to FIG. 9, the fluid accumulation reservoirs 14*a*, 14*b* are connected in series to the fluid support bladder section 12*f* through conduit 82. Manually operated shut-off valves 84, 86 are located in conduit 82 adjacent fluid accumulation reservoirs 14*a*, 14*b*, respectively. As used herein, shut-off valves 84, 86 are valves which can be opened or closed manually. Once opened, the valves 84, 86 stay open until manually closed. Once closed, the valves 84, 86 stay closed until manually opened. Accordingly, the manually operated shut-off valves 84, 86 control the passage of fluid between the fluid support bladder section 12*f* and each of the reservoirs 14*a*, 14*b*. When applying a user load to the cushioning device 10, the manually operated valves are opened, based on the weight of the user. For example, in this embodiment, for a user weighing less than 150 lbs, valve 84 is opened to enable fluid to flow between fluid support bladder section 12*f* and fluid accumulation reservoir 14*a*. For a user weighing more than 150 lbs, valves 84 and 86 are opened to enable fluid to flow between fluid bladder support section 12*f* and fluid accumulation reservoirs 14*a* and 14*b*. Although two fluid accumulation reservoirs 14 are shown, any number of fluid accumulation reservoirs may be used. The greater the number of fluid accumulation reservoirs, the greater the number of weight ranges of the user that can be controlled. In addition, the cushioning device 10 may be provided without valve 84.

As shown in FIGS. 8 and 9, the cushioning device further includes a low air loss system 52'. In this embodiment, the low air loss system 52' includes a low air loss line 54' which is connected to a supply of fluid (not shown) and two low air loss tubes 56' which extend lengthwise adjacent the fluid bladder support section 12*f*. In addition, referring to FIG. 8, the cushioning device 10 includes user restraint structures 88. In this particular embodiment, a single restraint structure 88 extends along both sides of the cushioning device 10 and is formed into the top layer 42. However, the restraint structures may comprise any number of sections extending along the length of both sides of the cushioning device 10. In an alternative embodiment, the restraint structures may extend only partially along the sides of the cushioning device 10. For example, the restraint structures could include only a head-end portion or only a foot end portion. The restraint structures help restrain the user on the cushioning device by providing a structure to reduce the risk that the user will accidentally fall from the cushioning device.

In an alternative embodiment, the restraint structures may be interconnected (i.e., in fluid communication) with the fluid support bladder section 12*f* through at least one air channel (or other inflation medium transfer channel) and, therefore, are filled with the fluid support bladder section 12*f* of the cushioning device 10. Alternatively, the restraint structures may be attached to the sides of the cushioning device 10.

As shown in FIG. 8, the restraint structures extend above a first surface 90 of the top layer 42. However, the restraint structures may extend in any desired dimensions to restrain the user. Suitable restraint structures are described, for example, in U.S. patent application Ser. No. 10/134,341, filed Apr. 26, 2002, which is hereby incorporated by reference in its entirety.

In addition, as shown in FIG. 7, an additional layer 92 is provided adjacent a portion of top layer 42 for additional cushioning. Suitable materials for the additional layer 92 include, but are not limited to, urethane foam, visco elastic foam, polyethylene foam, polypropylene foam, fiber fill, and polybeads. Although, in this embodiment, the additional layer 92 only partially covers top layer 42, the additional layer 92 may cover all or any part of top layer 42.

Further, as shown in FIGS. 7 and 8, in this particular embodiment, the top layer 42 includes channels 94 to allow air movement and expansion of the foam, as described above.

As shown in FIGS. 7 and 8, handles 96 are provided to facilitate transport and placement of the cushioning device 10. Referring to FIG. 9, the cushioning device 10 includes an inlet 98 for receiving fluid from an inlet hose (not shown). The inlet 98 may be placed at any position on the cushioning device 10 and is closed during use. The system, once closed, contains fluid which is substantially at atmospheric pressure when no load is applied to the mattress.

Figure 10:
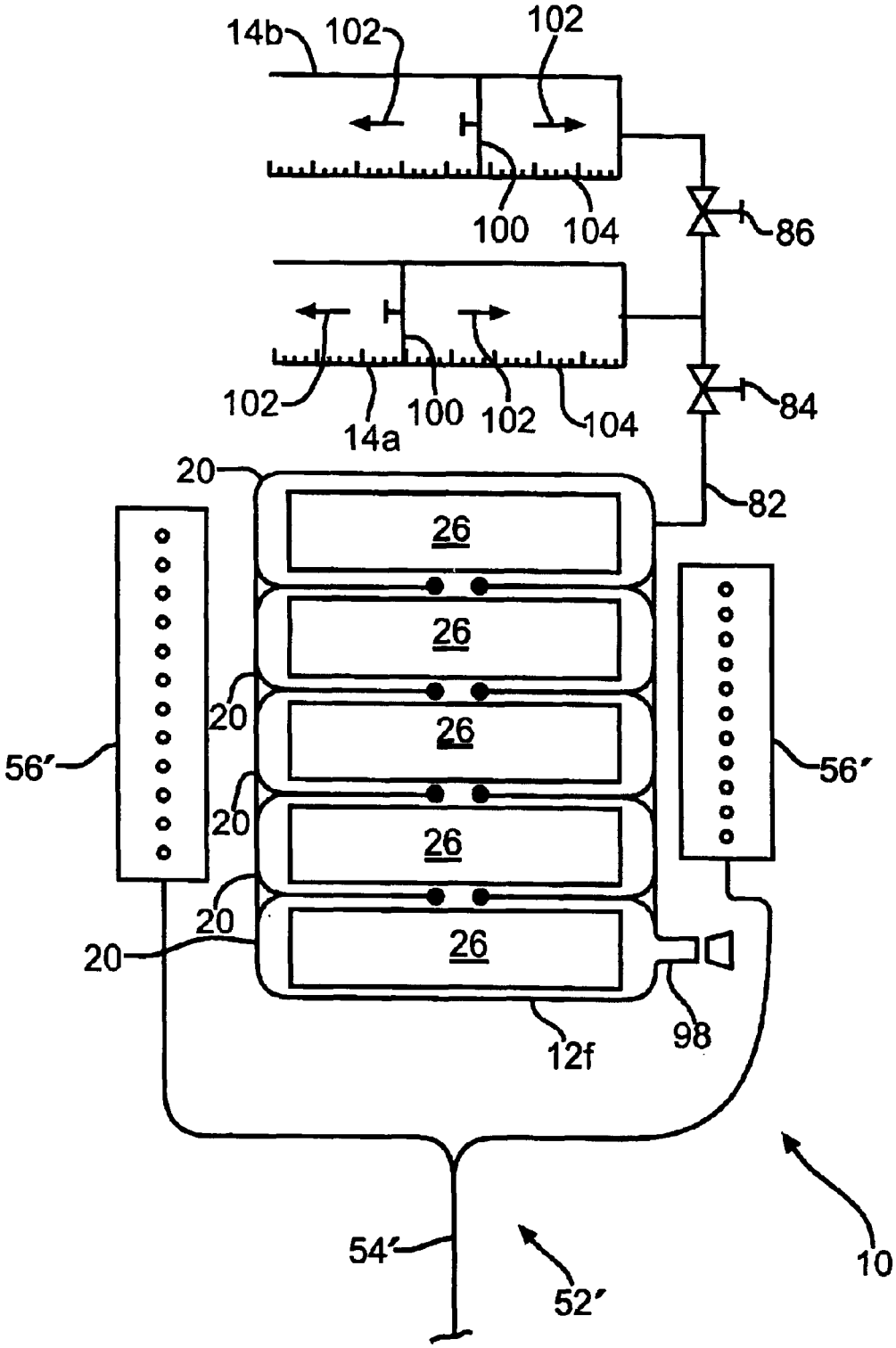
FIG. 10 is a schematic of a sixth embodiment of the present invention.

A sixth embodiment of the present invention is shown in FIG. 10. This embodiment of the present invention is identical to the previously described embodiment, except as described below.

Referring to FIG. 10, fluid accumulation reservoirs 14*a* and 14*b* have an adjustable volume (i.e., the maximum volume of reservoirs 14*a* and 14*b* is adjustable). In this particular embodiment, fluid accumulation reservoirs 14*a*, 14*b* are rigid chambers and include a plunger 100 within the reservoirs. Each plunger 100 is movable in the direction of arrows 102, such that the maximum volume of the reservoirs 14*a* and 14*b* is determined by the position of the plunger 100. Although rigid chambers with a plunger are shown, any other suitable variable volume accumulation reservoir may be used, such as a flexible chamber with a clip. The adjustment device (e.g., plunger or clip) may be variously positioned to set a volume for each fluid accumulation reservoir based on the weight of the user. In particular, in this embodiment, a scale 104 is provided on each fluid accumulation reservoir 14*a*, 14*b*. Once the volume of each fluid accumulation reservoir is fixed based on the weight of the user, the volume of each fluid accumulation reservoir does not change (i.e., the plunger or clip does not move). Although two adjustable volume fluid accumulation reservoirs 14*a*, 14*b* are shown, any number of adjustable volume fluid accumulation reservoirs may be used. In addition, the cushioning device 10 may be provided without valves 84, 86.

Figure 11:
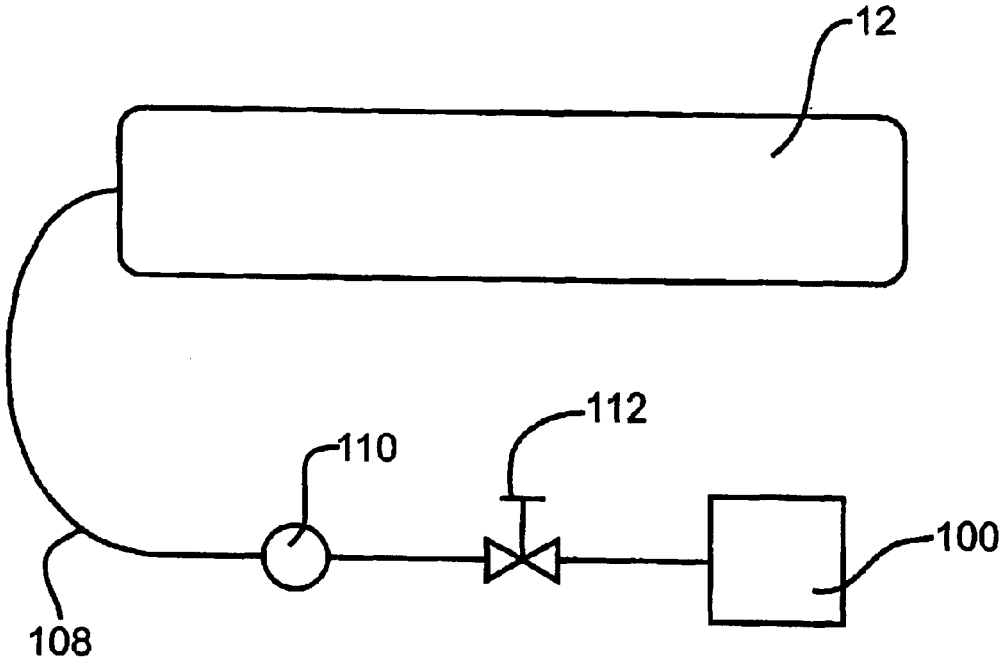
FIG. 11 is a schematic of a pressure monitoring system.

In yet another embodiment of the present invention, the cushioning device 10 may include a pressure monitoring system, such as that shown in FIG. 11. In particular, this embodiment of the pressure monitoring system includes a pump 106, which may be battery operated or plugged into a source of electricity. The pump 106 is connected to the fluid support bladder 12 through a conduit 108. In conduit 108 is a pressure sensor 110 and a shut-off valve 112. Sensor 110 is used to monitor the pressure within fluid support bladder 12. When the pressure drops below a desired level, pump 106 is turned on and shut-off valve 112 is opened to allow fluid to enter fluid support bladder 12 until the desired pressure is reached. Alternatively, the pump 106 and valve 112 may automatically operate to adjust the pressure within support bladder 12. A light system may be connected to the sensor 110 to indicate whether the pressure within fluid support bladder 12 is being measured and/or adjusted. Typically, such devices activate a light when the internal pressure of the fluid bladder support section 12 is below a certain level, indicating a bottoming condition. In an alternative embodiment, the sensor 110 may be integrated into the valve 112 through which fluid is being fed into the fluid support bladder 12 or may be positioned within fluid support bladder 12. Other embodiments of such devices are known in the art and are described, for example, in U.S. Pat. No. 5,140,309, which is hereby incorporated by reference in its entirety.

In a further embodiment, the cushioning device 10 of the present invention may be provided as part of a cushioning system including a bed having a frame, a plurality of legs, and a support structure, which, for example, may be a conventional box spring. The cushioning device 10 of the present invention may be positioned adjacent and in contact with the support structure, such that a user may rest on the first surface 16 of the cushioning device 10 which is positioned on the support structure. The cushioning system may be used, for example, in a hospital or home health care setting. The support structure and cushioning device 10 may be held together by any suitable device, such as forward and rear straps. The forward and rear straps may extend under the corners of the support structure or under the support structure from opposite sides and may attach to each other by suitable attachment devices, such as hook and loop fasteners and adhesives. As described above, a cover 44 may be provided over the cushioning device 10 and predetermined portions of the support structure, although it is not required. If a cover is used, the cover is preferably composed of an elastomeric material, which is stretchable and minimizes a "hammocking" effect that interferes with the effectiveness of the inflatable structure.

If desired, for example when utilizing a low air loss system or rotational bladder system, a conventional pump, blower, or other inflation device, which supplies air or other suitable medium to the cushioning device 10 may be attached onto the frame at the foot end of the bed.

Although the cushioning system described above is a bed with a box spring, any suitable type of support structure may be used. For example, other suitable support structures include, but are not limited to, mattresses, chairs, and wheelchairs. The cushioning device 10 is suitably shaped (e.g., rectangular, square, oval, or circular) and sized to be received by a desired portion of the support structure.

The cushioning device 10 of the present invention may be made to be disposable, thereby eliminating the expense of cleaning and sanitizing the cushioning device 10 after each use, or reusable.

The use of the cushioning device 10 of the present invention will now be described in detail. In use, the cushioning device 10 is positioned on a support structure, such as a bed frame, box spring, chair, or floor. If desired, the cushioning device 10 is secured to the support structure. If present, the atmosphere adjustment valve 34 is closed, such that the fluid bladder support section(s) 12 of the cushioning device contain air which is substantially at atmospheric pressure when no load is applied to the cushioning device. In the alternative, if an inlet 98 is present, the cushioning device is filled with a fluid through the inlet 98, such that the fluid bladder support section(s) 12 contain fluid at a desired pressure when no load is applied to the cushioning device. Any desired fluid (e.g., air, water) may be used. Once filled, the inlet 98 is closed. A user 46 is then positioned on the cushioning device 10. When pressure or weight is applied through the user 46, the resilient device 26 in each cell 20 will compress and the pressure within each air cell 20 will increase. Each cell 20 in the fluid bladder support section(s) 12 may relieve pressure by adjusting each fluid bladder support section 12 to a predetermined pressure in response to user positioning and movement.

In particular, referring to the embodiment shown in FIGS. 1–3, excess fluid in each fluid support bladder section 12*a–c* will travel through conduit 24 until the desired pressure, as determined by the pressure valves 28, is reached in each fluid bladder support section 12*a–c*. Excess fluid from fluid bladder support section 12*c* is routed to fluid accumulation reservoir 14 where it is stored. When pressure or weight is removed, either by removal or movement of the user 46, the resilient device 26 expands creating a partial vacuum within the cells 20 of the fluid bladder support sections 12*a–c*. This partial vacuum causes the opening of the one-way valve 32 in return conduit 30 positioned between the fluid accumulation reservoir 14 and fluid bladder support section 12*a*. Opening of the valve 32 allows fluid to flow from the fluid accumulation reservoir 14 into fluid bladder support section 12*a*, and subsequently to fluid bladder support sections 12*b* and 12*c*.

If present, low air loss system 52 is activated to produce a flow of air through tubes 56 beneath the user. In addition, if present, bladders 64, 66 are activated to turn the user from side to side. Further, if present, alternating pressure system 72 is activated to provide at least two series of alternating cells, which are alternately inflated and deflated, one series of cells being inflated while the other series of cells is deflated.

Referring to the embodiment shown in FIG. 6, excess fluid in each fluid support bladder section 12*a–c* will travel through pressure relief valves 28*a–c*, respectively, until the desired pressure, as determined by the pressure relief valves 28*a–c*, is reached in each fluid bladder support section 12*a–c*. Excess fluid from fluid bladder support sections 12*a–c* is routed to fluid accumulation reservoir 14 where it is stored. When pressure or weight is removed, either by removal or movement of the user 46, the resilient device 26 expands creating a partial vacuum within the cells 20 of the fluid bladder support sections 12*a–c*. This partial vacuum causes the opening of one or more of the one-way valves 33. Opening of a valve 33 allows fluid to flow from the fluid accumulation reservoir 14 into the respective fluid bladder support section.

If present, low air loss system 52 is activated to produce a flow of air through tubes 56 beneath the user. In addition, if present, bladders 64, 66 are activated to turn the user from side to side. Further, if present, alternating pressure system 72 is activated to provide at least two series of alternating cells, which are alternately inflated and deflated, one series of cells being inflated while the other series of cells is deflated.

Referring to the embodiment shown in FIGS. 7–9, prior to or after positioning user 46 on cushioning device 10, valves 84 and/or 86 are opened based on the weight of the user. If only valve 84 is opened, excess fluid from fluid support bladder section 12*f* will travel through conduit 82 into fluid accumulation reservoir 14*a*, where it is stored. If both valve 84 and valve 86 are opened, excess fluid from fluid support bladder section 12*f* will travel through conduit 82 into fluid accumulation reservoirs 14*a* and 14*b*, as needed, where it is stored. When pressure or weight is removed, either by removal or movement of the user 46, the resilient device 26 within the cells 20 of fluid bladder support section 12*f* expands drawing fluid back into fluid bladder support section 12*f* from one or both of fluid accumulation reservoirs 14*a* and 14*b* through conduit 82. If present, low air loss system 52', rotational bladder system 58, and/or alternating pressure system 72 is activated.

Referring to the embodiment shown in FIG. 10, prior to or after positioning user 46 on cushioning device 10, plungers 100 are positioned in fluid accumulation reservoirs 14*a*, 14*b* based on the weight of the user. In addition, valves 84 and/or 86 are opened based on the weight of the user. If only valve 84 is opened, excess air from fluid support bladder section 12*f* will travel through conduit 82 into fluid accumulation reservoir 14*a*, where it is stored. If both valve 84 and valve 86 are opened, excess air from fluid support bladder section 12*f* will travel through conduit 82 into fluid accumulation reservoirs 14*a* and 14*b*, as needed, where it is stored. When pressure or weight is removed, either by removal or movement of the user 46, the resilient device 26 within the cells 20 of fluid bladder support section 12*f* expands drawing fluid back into fluid bladder support section 12*f* from one or both of fluid accumulation reservoirs 14*a* and 14*b* through conduit 82. If present, low air loss system 52', rotational bladder system 58, and/or alternating pressure system 72 is activated.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A cushioning device comprising:

a first fluid bladder support structure having a first surface and an opposing second surface;

a second fluid bladder support structure having a first surface and an opposing second surface, wherein the first and second fluid bladder support structures deform under application of a load and reform upon removal of the load;

at least one fluid accumulation reservoir;

a first conduit interconnecting the first fluid bladder support structure in fluid communication with the second fluid bladder support structure, wherein the first conduit comprises a first one-way valve which permits fluid flow from the first fluid bladder support structure to the second fluid bladder support structure;

a second conduit interconnecting the second fluid bladder support structure in fluid communication with the at least one fluid accumulation reservoir, wherein the second conduit comprises a second one-way valve which permits fluid flow from the second fluid bladder support structure to the at least one fluid accumulation reservoir and wherein the second one-way valve is a pressure relief valve; and a third conduit interconnecting the at least one fluid accumulation reservoir in fluid communication with the first fluid bladder support structure, wherein the third conduit comprises a third one-way valve which permits fluid flow from the at least one fluid accumulation reservoir to the first fluid bladder support structure.

2. The cushioning device according to claim 1 wherein the first and second fluid bladder support structures each comprise a plurality of interconnected cells.

3. The cushioning device according to claim 1 wherein the first and second fluid bladder support structures each comprise a plurality of individual cells.

4. The cushioning device according to claim 1 wherein the first and second fluid bladder support structures contain a resilient device.

5. The cushioning device according to claim 4 wherein the resilient device is a foam material.

6. The cushioning device according to claim 1 wherein the first and second fluid bladder support structures comprise a resilient material.

7. The cushioning device according to claim 1 wherein the first one-way valve is a pressure relief valve.

8. The cushioning device according to claim 6 wherein at least one of the first and second one-way valves is an adjustable pressure relief valve.

9. The cushioning device according to claim 1 further comprising:

an intermediate fluid bladder support structure having a first surface and an opposing second surface; and an intermediate conduit interconnecting the first fluid bladder support structure in fluid communication with the intermediate fluid bladder support structure, wherein the intermediate conduit comprises an intermediate one-way valve which permits fluid flow from the first fluid bladder support structure to the intermediate fluid bladder support structure and wherein the first conduit interconnects the intermediate fluid bladder support structure in fluid communication with the second fluid bladder support structure, the first one-way valve permitting fluid flow from the intermediate fluid bladder support structure to the second fluid bladder support structure.

10. The cushioning device according to claim 1 further comprising:

a retaining member surrounding one or all of the first fluid bladder support structure, the second fluid bladder support structure, and the at least one fluid accumulation reservoir.

11. The cushioning device according to claim 1 further comprising: at least one user restraint structure attached to at least a portion of the cushioning device.

12. The cushioning device according to claim 1 further comprising:

a pressure monitoring device operably connected to at least one of the first fluid bladder support structure and the second fluid bladder support structure.

13. The cushioning device according to claim 1 wherein at least one of the first and second fluid bladder support structures comprises a first plurality of cells in fluid communication with each other and a second plurality of cells in fluid communication with each other, wherein the first and second plurality of cells are alternatively inflated and deflated through an inflation-deflation device operably connected to the first and second plurality of cells.

14. A cushioning system comprising:

a cushioning device in accordance with claim 1; and an air loss system comprising at least one air loss device having a plurality of openings and an air supply operably connected to the at least one air loss device, wherein the at least one air loss device is adjacent at least one of the first fluid bladder support structure and the second fluid bladder support structure.

15. A cushioning system comprising:

a cushioning device in accordance with claim 1; and a rotational bladder system comprising first and second alternatively inflatable bladders positioned adjacent and in contact with the second surface of the first fluid bladder support structure and the second surface of the second fluid bladder support structure and an inflation device operably connected to the first and second inflatable bladders.

16. A method for cushioning a load on a cushioning device comprising:

providing a cushioning device according to claim 1, wherein the first and second fluid bladder support structures contain a fluid; and positioning the load on the cushioning device, wherein at least one of the first, second, and third one-way valves opens in response to changing loading on at least one of the first and second fluid bladder support structures.

17. A cushioning device comprising:

at least one fluid bladder support structure having a first surface and an opposing second surface, wherein the at least one fluid bladder support structure deforms under application of a load and reforms upon removal of the load;

a fluid accumulation reservoir structure, wherein the at least one fluid bladder support structure is positioned within the fluid accumulation reservoir structure;

at least one pressure relief valve in fluid communication with the at least one fluid bladder support structure and the fluid accumulation reservoir structure, wherein the at least one pressure relief valve is a first one-way valve which permits fluid flow from the at least one fluid bladder support structure to the fluid accumulation reservoir structure; and at least one second one-way valve in fluid communication with the at least one fluid bladder support structure and the fluid accumulation reservoir structure, wherein the at least one second one-way valve permits fluid flow from the fluid accumulation reservoir structure to the at least one fluid bladder support structure.

18. The cushioning device according to claim 17 wherein the at least one fluid bladder support structure comprises a plurality of interconnected cells.

19. The cushioning device according to claim 17 wherein the at least one fluid bladder support structure comprises a plurality of individual cells.

20. The cushioning device according to claim 17 wherein the at least one fluid bladder support structure contains a resilient device.

21. The cushioning device according to claim 20 wherein the resilient device is a foam material.

22. The cushioning device according to claim 17 wherein the at least one fluid bladder support structure comprises a resilient material.

23. The cushioning device according to claim 17 wherein the pressure relief valve is an adjustable pressure relief valve.

24. The cushioning device according to claim 17 further comprising:

a retaining member surrounding the fluid accumulation reservoir structure.

25. The cushioning device according to claim 17 further comprising:

at least one user restraint structure attached to at least a portion of the cushioning device.

26. The cushioning device according to claim 17 further comprising:

a pressure monitoring device operably connected to the at least one fluid bladder support structure.

27. The cushioning device according to claim 17 wherein the at least one fluid bladder support structure comprises a first plurality of cells in fluid communication with each other and a second plurality of cells in fluid communication with each other, wherein the first and second plurality of cells are alternatively inflated and deflated through an inflation-deflation device operably connected to the first and second plurality of cells.

28. A cushioning system comprising:

a cushioning device in accordance with claim 17; and an air loss system comprising at least one air loss device having a plurality of openings and an air supply operably connected to the at least one air loss device, wherein the at least one air loss device is adjacent the fluid accumulation reservoir structure.

29. A cushioning system comprising:

a cushioning device in accordance with claim 17; and a rotational bladder system comprising first and second alternatively inflatable bladders positioned adjacent and in contact with at least one of the second surface of the at least one fluid bladder support structure and the fluid accumulation reservoir structure and an inflation device operably connected to the first and second inflatable bladders.

30. A method for cushioning a load on a cushioning device comprising:

providing a cushioning device according to claim 17, wherein the at least one fluid bladder support structure contains a fluid; and positioning the load on the cushioning device, wherein at least one of the pressure relief valve and the second one-way valve opens in response to changing loading on the at least one fluid bladder support structure.

31. A cushioning device comprising:

at least one fluid bladder support structure, wherein the at least one fluid bladder support structure deforms under application of a load and reforms upon removal of the load;

a plurality of fluid accumulation reservoirs interconnected to be in fluid communication; and at least one manual shut-off valve in fluid communication with the at least one fluid bladder support structure and at least one of the plurality of fluid accumulation reservoirs.

32. The cushioning device according to claim 31 wherein the at least one fluid bladder support structure comprises a plurality of interconnected cells.

33. The cushioning device according to claim 31 wherein the at least one fluid bladder support structure comprises a plurality of individual cells.

34. The cushioning device according to claim 31 wherein the at least one fluid bladder support structure contains a resilient device.

35. The cushioning device according to claim 34 wherein the resilient device is a foam material.

36. The cushioning device according to claim 31 wherein the at least one fluid bladder support structure comprises a resilient material.

37. The cushioning device according to claim 31 further comprising:

a retaining member surrounding one or more of the at least one fluid bladder support structure and the plurality of fluid accumulation reservoirs.

38. The cushioning device according to claim 31 further comprising:

at least one user restraint structure attached to at least a portion of the cushioning device.

39. The cushioning device according to claim 31 further comprising:

a pressure monitoring device operably connected to the at least one fluid bladder support structure.

40. The cushioning device according to claim 31 wherein the plurality of fluid accumulation reservoirs have an adjustable volume.

41. A cushioning system comprising:

a cushioning device in accordance with claim 31; and an air loss system comprising at least one air loss device having a plurality of openings and an air supply operably connected to the at least one air loss device, wherein the at least one air loss device is adjacent the at least one fluid bladder support structure.

42. A cushioning system comprising:

a cushioning device in accordance with claim 31; and a rotational bladder system comprising first and second alternatively inflatable bladders positioned adjacent and in contact with the second surface of the at least one fluid bladder support structure and an inflation device operably connected to the first and second inflatable bladders.

43. A method for cushioning a load on a cushioning device comprising:

providing a cushioning device according to claim 31, wherein the at least one fluid bladder support structure contains a fluid;

applying the load to the cushioning device; and opening one or more of the at least one manual shut-off valves based on the weight of the load.

* * * * *